US006039622A

United States Patent [19]

Kosaka et al.

[11] Patent Number: 6,039,622

[45] Date of Patent: Mar. 21, 2000

[54] METHOD OF FORMING BARRIER RIBS OF DISPLAY PANEL

[75] Inventors: Tadayoshi Kosaka; Osamu Toyoda; Fumihiro Namiki, all of Kawasaki, Japan

[73] Assignee: Fujitsu Limited, Kawasaki, Japan

[21] Appl. No.: 08/889,195

[22] Filed: Jul. 8, 1997

[30] Foreign Application Priority Data

Jan. 13, 1997 [JP] Japan ..... 9-003975

[51] Int. Cl.[7] ..... H01J 9/00; H01J 9/14

[52] U.S. Cl. ..... 445/52; 445/24

[58] Field of Search ..... 445/52, 24, 25; 451/29; 156/153, 154

[56] References Cited

U.S. PATENT DOCUMENTS 5,011,391 4/1991 Kawasaki et al. ..... 445/24
5,593,528 1/1997 Dings et al. ..... 156/154
5,860,843 1/1999 Kasahara ..... 445/24

FOREIGN PATENT DOCUMENTS 4-95328 3/1992 Japan .
5-266791 10/1993 Japan .
7-161298 6/1995 Japan .

*Primary Examiner*—Vip Patel
*Assistant Examiner*—Michael J. Smith
*Attorney, Agent, or Firm*—Staas & Halsey LLP

[57] ABSTRACT

A method of forming barrier ribs of a display panel includes the steps of forming a layer of a dielectric paste containing a powdery component and a binder component as a layer of a barrier rib material in a predetermined thickness on a substrate, forming a mask pattern on the dielectric paste layer, jetting a cutting medium onto the dielectric paste layer through the mask pattern to partially cut the dielectric paste layer to thereby form a cut barrier rib layer, and sintering the cut barrier rib layer to make barrier ribs, wherein, prior to forming the mask pattern, a bind film is formed for fixing the powdery component in a free state on the surface of the dielectric paste layer.

22 Claims, 15 Drawing Sheets

PASTE LAYER HAVING A ROUGH SURFACE

COATING WITH A PASTE CONTAINING PARTICLES HAVING A SMALL DIAMETER

COATING WITH A LOW-VISCOSITY PASTE

POOR ADHESION

GOOD ADHESION

GOOD ADHESION

METHOD OF FORMING BARRIER RIBS OF DISPLAY PANEL

BACKGROUND OF THE INVENTION

1. Field of the Invention

The present invention relates to a method of forming barrier ribs of a display panel, particularly a method of forming barrier ribs of a display panel such as a plasma display panel (PDP), a plasma addressing liquid crystal panel and a field emission display panel, which includes barrier ribs for providing partitions for pixels and maintaining a spacing between a front substrate and a rear substrate.

2. Description of Related Arts

These kinds of display panels are used in various fields. The PDP, in particular, is suitable for a high-vision display since it exhibits an excellent visibility and a high display speed. The PDP has been attracting considerable attention in recent years.

The PDP is a self-luminous display panel having a discharge space defined between a pair of substrates with electrodes arranged in a matrix therein. The pair of substrates are spaced at a minute distance in an opposing relation and the peripheries thereof are sealed together.

The PDP using a matrix display system are provided with barrier ribs having a height of about 100 $\mu$m to about 200 $\mu$m for partitioning the discharge space. For example, a PDP of a surface discharge type suitable for fluorescent color display includes linear barrier ribs equidistantly arranged across lines for display. The distant between adjacent barrier ribs is, for example, about 200 $\mu$m for a 21-inch color PDP. The barrier ribs prevent discharge coupling and color cross-talk between adjacent cells.

Known methods of forming the barrier ribs include a screen printing method, a sandblast method and a hydro-honing method.

In the screen printing method, a pattern of a barrier rib configuration is repeatedly printed ten-odd times to form the barrier ribs. The screen printing method has the advantage of making the most of materials and reducing production costs. However, there arise problems in screen production accuracy, repeated printing accuracy and durability of the screen when barrier ribs are to be formed over a large-sized display panel exceeding 40 inches or when barrier ribs having a minute width are to be arranged at a very small distance for a small-sized high-definition display panel.

In the sandblast method, fine cutting particles are carried on a flow of air and jetted onto a layer of a barrier-rib material with a cutting mask pattern formed thereon before hand, to cut a portion that is not covered with the cutting mask pattern to form barrier ribs. The sandblast method has problems of wastes of the barrier-rib material removed by cutting and increasing costs due to a necessary photolithography. However, the sandblast method has the advantage of achieving a higher accuracy over the screen printing method.

In the hydro-honing method, liquid such as water is jetted for cutting. The hydro-honing method is almost the same as the aforesaid sandblast method in process and possesses a similar advantage thereto.

The sandblast and hydro-honing methods are often used for forming barrier ribs for a large-sized display panel or a small-sized high-definition display panel because these methods are suitable for attaining a high accuracy.

An exemplary prior art formation of barrier ribs using the sandblast method is explained for a color PDP, particularly an AC-driven PDP of the surface discharge type.

FIGS. 14A to 14D illustrate the formation of barrier ribs for a PDP using the sandblast method. As shown in the figures, the barrier ribs are formed by the following processes:

A base layer, an address electrode and an insulating layer are formed on a rear glass substrate 21 (the base layer, address electrode and insulating layer are not shown). A layer of a barrier rib material 51 is formed in a desired thickness over the insulating layer (see FIG. 14A). As the barrier rib material, used is a glass paste containing a glass powder and resin components as a filler and a binder. The barrier rib material layer 51 is dried and a mask pattern 54 of a barrier rib configuration is formed on the barrier rib material layer 51 by photolithography (see FIG. 14B). A cutting medium is jetted thereon by a sandblaster 70 to cut a portion of the barrier rib material layer 51 that is not covered with the mask pattern 54. The barrier rib material layer is thus formed into a cut barrier rib layer corresponding to barrier ribs (see FIG. 14C). The mask pattern 54 is peeled off and then the cut barrier rib layer is sintered into glass barrier ribs 29 (see FIG. 14D).

In the field emission display panel and in a monochromatic PDP having a large dot pitch, glass beads having a diameter of several hundred $\mu$m are generally provided as spacers between the front and rear substrates to ensure the spacing therebetween. In this case, pixels do not necessarily need to be separated by partitions. It is enough to ensure the spacing between the front and rear substrates. However, barrier ribs similar to those of the plasma display, if used, enhances the visibility. For this reason, the barrier ribs are sometimes formed for the field emission display panel and the monochromatic PDP.

The above described sandblast method is a useful method for forming the barrier ribs for a plane display panel. However, when the barrier rib material layer is cut by the sandblast method, especially as the width of the barrier ribs is reduced, adhesion between the mask pattern and the barrier rib material layer drops. Sometimes the mask pattern peels off from the barrier rib material layer during cutting.

To ensure a close adhesion between the mask pattern and the barrier rib material layer, the amount of the binder component in the barrier rib material may be increased. However, the increase in the amount of the binder component causes a decline in a cutting rate, and the decline in the cutting rate gives rise to a further need to strengthen the adhesion between the mask pattern and the barrier rib material layer.

To solve this problem, it is necessary to improve the adhesion without reducing the cutting rate. Japanese Unexamined Patent Publication No.Hei 7(1995)-161298 proposes a solution therefor. In a proposed method, the amount of the binder component in the barrier rib material is not changed, but on this barrier rib material layer, a second barrier rib material layer is formed which contains an increased amount of the binder component. According to this method, the adhesion between the mask pattern and the barrier rib material layer is expected to be strengthened to some extent without significantly reducing the cutting rate of the sandblasting. However, when the barrier ribs are to be arranged at a more minute distance for securing a display panel of higher-definition, the width of the barrier rib must also be reduced. Accordingly, the adhesion between the mask pattern and the barrier rib layer needs to be further strengthened.

As an alternative solution, a top surface of the barrier rib material layer may be roughened. However, the top surface of the barrier ribs is desired to be as flat as possible since the barrier ribs are formed for prohibiting discharge coupling between the partitions. If the barrier ribs have a rough top surface, they do not contact the front substrate closely when the front and rear substrates are assembled into a display panel. This results in gaps between the barrier ribs and the front substrate which allow discharge coupling. As a result, the quality of the display panel is debased.

Additionally, Japanese Unexamined Patent Publication No. Hei 4(1992)-95328 discloses a method for flattening the top surface of the barrier ribs.

SUMMARY OF THE INVENTION

The present invention has been made with the above considerations, and a purpose of the invention is to provide a method of forming barrier ribs of a display panel wherein the adhesion between the mask pattern and the barrier rib material layer is improved while ensuring the flatness of the top surface of the barrier ribs.

The present invention provides a method of forming barrier ribs of a display panel comprising the steps of forming a layer of a dielectric paste comprising a powdery component and a binder component as a layer of a barrier rib material in a predetermined thickness on a substrate, forming a mask pattern on the dielectric paste layer, jetting a cutting medium onto the dielectric paste layer through the mask pattern to partially cut the dielectric paste layer to thereby form a cut barrier rib layer, and then sintering the cut barrier rib layer to make barrier ribs, wherein, prior to forming the mask pattern, a bind film is formed for fixing the powdery component in a free state on the surface of the dielectric paste layer.

According to the present invention, since the free powdery component such as glass powder existing on the surface of the dielectric paste layer is fixed by the bind film, the adhesion of the mask pattern can be improved. Consequently, resistance to cutting work can be improved and a finer pattern than conventionally obtained can be formed. Further, the barrier ribs can be made to have a flat top surface without impairing the adhesion of the mask pattern.

DESCRIPTION OF THE PREFERRED EMBODIMENTS

In order to solve the problem of the peel-off of the mask pattern during the cutting of the barrier rib material layer, the inventors observed mating surfaces of mask patterns and barrier rib material layers after the peeling-off of the mask patterns and found out the following.

Figure 15B:
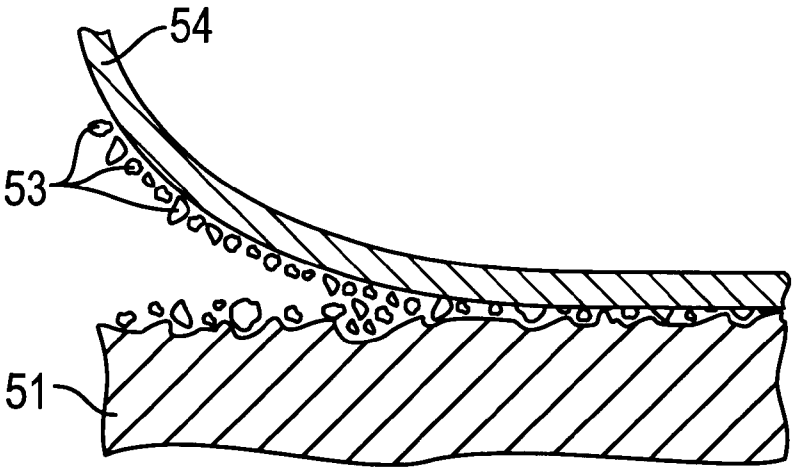
FIGS. 15A and 15B are sectional views illustrate mating surfaces of a conventional mask pattern and barrier rib material layer.
Figure 15A:
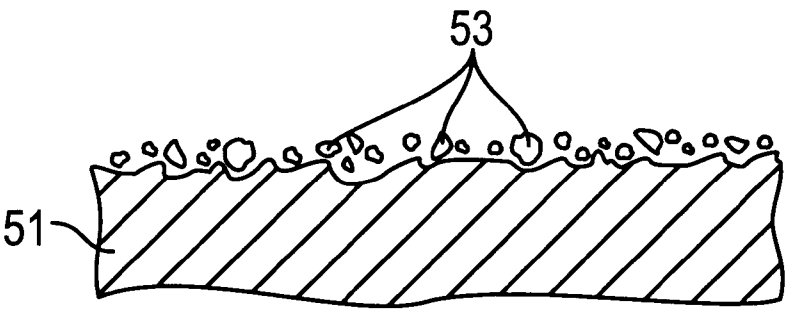

Referring to FIGS. 15A and 15B, powdery components 53 contained in the barrier rib material, for example, glass powder and powdery filler in the case of glass paste, were observed adhering to the mating surface of the peeled-off mask pattern 54 here and there, and the mating surface of the barrier rib material layer 51 was found rougher than before the peel-off (see FIG. 15B). This shows that the barrier rib material layer 51 has a thin layer of free powdery components which do not completely adhere to the surface of the barrier rib material layer 51, before the formation of the mask pattern 54 (see FIG. 15A). Via this layer of the powdery components, the mask pattern 54 adheres to the barrier rib material layer 51. It is impossible to prevent the forming of the layer of the powdery components by the foregoing method of forming the second barrier rib material layer containing an increased amount of the binder component on the barrier rib material layer. That is, it cannot be prevented only by increasing the amount of the binder component in the barrier rib material.

Figure 1B:
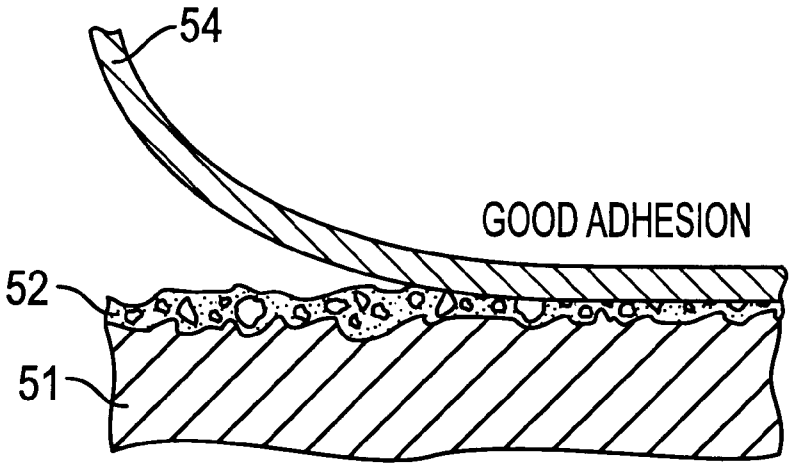
FIGS. 1A and 1B are sectional views illustrating an improvement of the adhesion of a mask pattern.
Figure 1A:
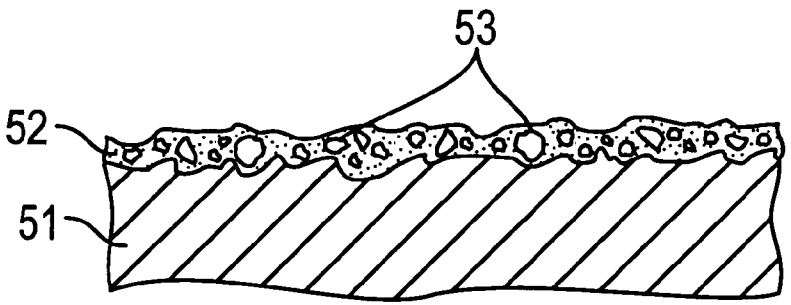

As shown in FIGS. 1A and 1B, the present inventors have invented a method in which, after the formation of the barrier rib material layer 51, a bind film 52 is formed thereon which does not contain powdery components (see FIG. 1A). Thereby, the binder in the bind film soaks into the thin layer of the free powdery components 53 and fixed the powdery components 53 on the barrier rib material layer 51. Thus, the adhesion between the mask pattern 54 and the barrier rib material layer 51 is improved (see FIG. 1B).

Figure 2A:
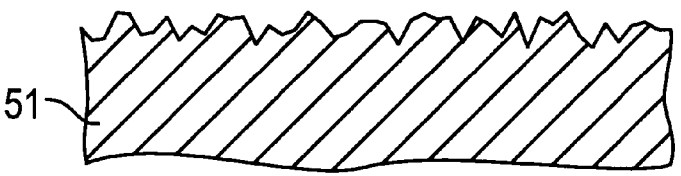
FIGS. 2A to 2C are sectional views illustrating improvements of the flatness of the top surface of barrier ribs.
Figure 2B:
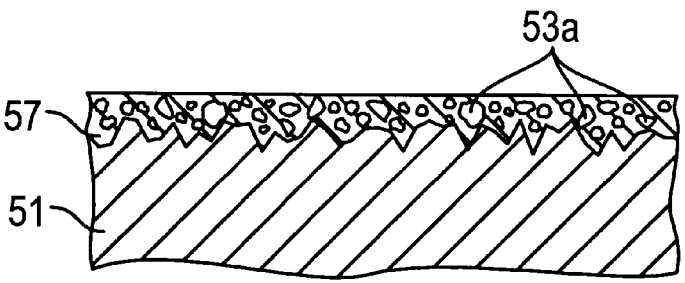
Figure 2C:
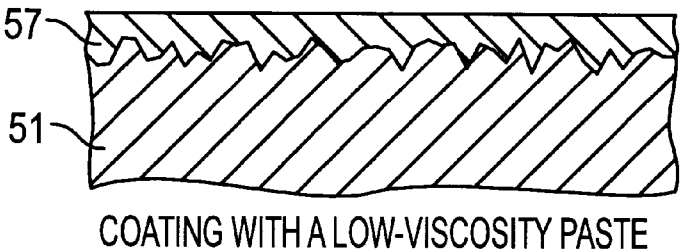

In order to flatten the top surface of the barrier ribs, on the other hand, a flat layer 57 is formed on the barrier rib material layer, as shown in FIGS. 2A to 2C. The inventors have found a method of smoothing the top surface of the barrier ribs by coating the barrier rib material layer 51, i.e., a paste layer, having a rough surface (see FIG. 2A) with a flat layer 57 containing a powdery component 53*a* having a diameter smaller than that of the powdery components contained in the barrier rib material layer 51 (see FIG. 2B), or by coating the barrier rib material layer 51 having a rough surface with a low-viscosity flat layer 57 of a paste having low viscosity and thus having a better leveling characteristic (see FIG. 2C).

Figure 3B:
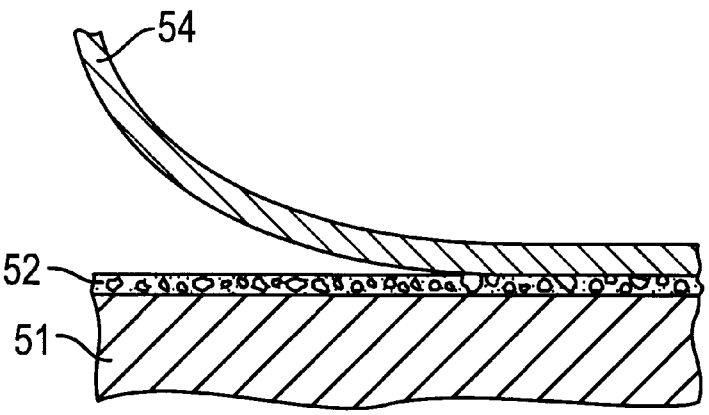
FIGS. 3A to 3C are sectional views illustrating the relationship between the flatness of a barrier rib material layer and the adhesion of a mask pattern.
Figure 3A:
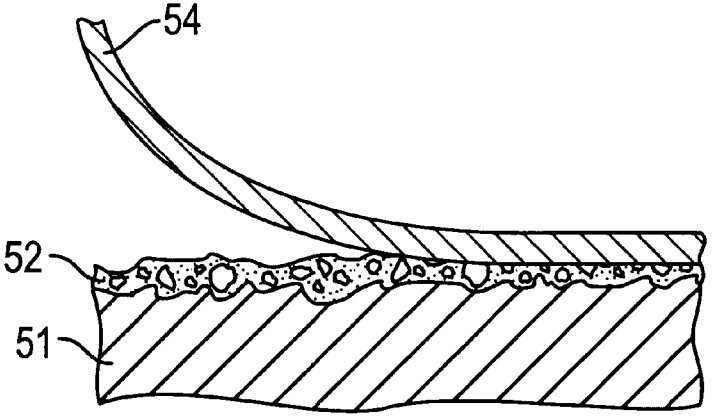
Figure 3C:
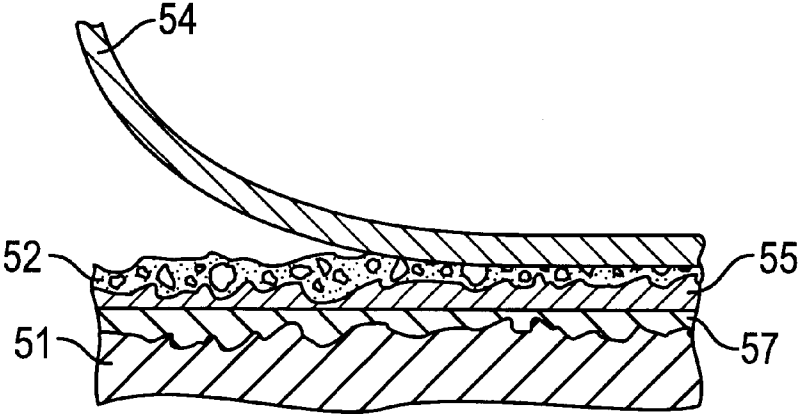

However, as shown in FIGS. 3A to 3C, it has been observed that, even if the bind film 52 is formed, the adhesion between the mask pattern 54 and the barrier rib material layer 51 is poor in the case where the surface of the barrier rib material layer 51 is flat (see FIG. 3B), while the adhesion between the mask pattern 54 and the barrier rib material layer 51 is good in the case where the surface of the barrier rib material layer 51 is rough (see FIG. 3A).

The adhesion between the mask pattern 54 and the barrier rib material layer 51 must be improved and the top surface of the barrier ribs must be flattened. In order to solve these two contradictory problems at the same time, the inventors have found a method in which the flattening layer 57 is formed on the barrier rib material layer 51 having a rough surface to smooth the surface of the barrier rib material layer 51, an adhesion-strengthen film 55 having a rough surface is formed thereon to strengthen the adhesion to the mask pattern 54, a bind film 52 is formed thereon (see FIG. 3C), and, after the barrier ribs are formed by the sandblast method, the adhesion-strengthen film 55 is removed to expose the flat layer 57 having a flat surface.

In the present invention, applicable as the substrate is a rear glass substrate generally known in the field of PDPs for color display, on which electrodes are formed beforehand.

The dielectric paste layer, i.e., the barrier rib material layer, may be formed on the substrate, for example, by the screen printing method, a blade coating method or a green-sheet method.

For the screen printing method and blade coating method, a dielectric paste prepared by mixing a dielectric powder, an organic binder and filler may be used as the barrier rib material. For example, glass powder and ceramic powder may be used as the dielectric powder, and ethyl cellulose, acrylic resin and nitrocellulose, etc., may be used as the organic binder. A dielectric paste containing glass powder as the dielectric powder is called glass paste. Preferably, low-melting-point glass paste using low-melting-point glass as a dielectric material may be used as the dielectric paste layer.

In the green-sheet method, a plastic sheet known as a green sheet composed of an organic binder and dielectric powder such as glass or ceramic powder is put on a substrate by a pressure roll, and preliminarily sintered at 300° C. to 400° C. to remove the organic components. A barrier rib material layer is thus formed. The removal of the organic components is applied for improving the cutting.

The mask pattern may be formed by so-called photolithography. That is, a photoresist or photo sensitive dry film is put on the barrier rib material layer, and then, the photoresist or photosensitive dry film is covered with a light-exposure mask, exposed to light, and developed to form a mask pattern.

The barrier rib material layer may be cut by the sandblast method, hydro-honing method, or the like. In the case of using the sandblast method, an abrasive material of several ten pm in size is jetted as a cutting medium onto the barrier rib material layer on an airflow by using a sandblaster to cut the portion of the barrier rib material layer which is not covered with the mask pattern. For convenience in description, the barrier rib material layer formed into a patterned barrier rib configuration is simply referred to as a cut barrier rib layer.

The cut barrier rib layer may be sintered by a method usually applied in this field. The sintering may be carried out at a temperature suitable for the material of the barrier ribs. For example, where the glass paste is used as the barrier rib material, the sintering is carried out at a temperature such that the binder component in the glass paste can be burnt off and at the same time the glass powder in the glass paste can be softened and fused to each other. For example, where the glass paste is used for sintering the cut barrier rib layer of a PDP sized about 20 to 40 inches, the sintering temperature may generally be about 500° C. to about 600° C.

In the present invention, any material may be used as the bind film which is applicable as coating onto the dielectric paste layer of the barrier rib material, is capable of fixing the powdery components on the dielectric paste layer and has almost the same hardness as that of the dielectric paste layer. Considering availability, the bind film may be formed using a liquid obtained by adding a solvent to the same kind of binder as the binder component of the dielectric paste for the barrier ribs, such as ethyl cellulose, acrylic resin or nitrocellulose. As the solvent, Terpineol, Butyl Carbitol Acetate (BCA) and the like may be used.

Accordingly, the bind film can be formed by coating the dielectric paste layer with a liquid of the solvent and the binder component of the dielectric paste from which the powdery component is excluded, followed by drying.

In the case where the barrier rib material layer is formed by the green-sheet method, the bind film does not necessarily need to be formed.

Where the barrier rib material layer is formed by the blade coating or green-sheet method, it is preferable to roughen the surface of the barrier rib material layer to strengthen the adhesion between the barrier rib material layer and the mask pattern because the surface of the barrier rib material layer is relatively flat.

For roughening the surface of the barrier rib material layer, the barrier rib material layer, after being formed on the substrate, may be covered with an adhesion-strengthen film having a rougher surface than the barrier rib material layer. As the adhesion-strengthen film, a glass paste film may be formed by the screen printing method.

Since the top surface of the barrier ribs is required to be flat, this adhesion-strengthen film may preferably be removed or flattened by abrading the surface of the layer, after sintering the cut barrier rib layer.

In another aspect, the present invention provides a method of forming barrier ribs of a display panel comprising the steps of forming a layer of a barrier rib material on a substrate, forming a mask pattern on the barrier rib material layer, jetting a cutting medium onto the barrier rib material layer through the mask pattern to partially cut the barrier rib material layer to thereby form a cut barrier rib layer, and sintering the cut barrier rib layer to make barrier ribs, wherein, before the formation of the mask pattern, an adhesion-strengthen film is formed on the surface of the barrier rib material layer for strengthening the adhesion between the barrier rib material layer and the mask pattern, the adhesion-strengthen film having a rougher surface than the barrier rib material layer.

In this invention, the barrier rib material layer may be formed on the substrate by the screen printing method, the blade coating method, the green-sheet method or the like. As the barrier rib material, a dielectric paste or the aforesaid green sheet may be used.

For the need to form a layer having a rougher surface than the barrier rib material layer, the adhesion-strengthen film is preferably formed by the screen printing method using a screen with large meshes. The adhesion-strengthen film may be formed of the same material as the barrier rib material or a material containing a glass component having a larger particle diameter than that of the barrier rib material. Alternatively, the adhesion-strengthen film may be formed of a dielectric paste containing a different dielectric from that of the barrier rib material. Or a $SiO_2$ glass paste may be used which has a softening point higher than the working temperature during manufacture. In the case where the adhesion-strengthen film is made of the $SiO_2$ glass paste, the $SiO_2$ glass paste does not fuse partially to the barrier rib material layer during sintering as the low-melting point glass paste does. Therefore, the flatness of the surface of the barrier rib material layer is not impaired. In addition to that, the adhesion-strengthen film of the $SiO_2$ glass paste can easily be removed by an ultrasonic cleaning or air blowing.

In the case where the adhesion-strengthen film is made of the dielectric paste, the free powdery component exists on the surface after the formation of the adhesion-strengthen film on the barrier rib material layer. And accordingly, it is preferable to form a bind film on the adhesion-strengthen film of the dielectric paste in order to fix the powdery component.

The bind film may be made of the binder component of the dielectric paste for the barrier ribs or the binder component of the dielectric paste for the adhesion-strengthen film without the powdery components.

For flattening the top surface of the barrier ribs, the adhesion-strengthen film may preferably be removed or flattened by abrading the surface of the layer after sintering the cut barrier rib layer, as described above.

Alternatively, for removing the adhesion-strengthen film, a lift-off layer may be formed on the barrier rib material layer before the formation of the adhesion-strengthen film. The lift-off layer is made of a powdery material having a heat resistance such that the material does not change during sintering the cut barrier rib layer. The adhesion-strengthen film can be removed together with the lift-off layer after sintering the cut barrier rib layer.

Any powdery material may be used for the lift-off layer which does not change at the maximum temperature during the manufacture, for example, during sintering. Examples of such materials are fine powders of aluminum oxide, titanium oxide and the like. The lift-off layer may be formed by a printing or bar-coat method. The lift-off layer may be removed by the ultrasonic cleaning, air blowing or the like.

For flattening the top surface of the barrier ribs, a flat layer may be provided on the barrier rib material layer which contains powder having a smaller particle diameter than the powder contained in the barrier rib material.

The flat layer may be made of the same material as the barrier rib material but only the viscosity is reduced.

EXAMPLES

The present invention is hereinafter described in more detail by way of examples with reference to the accompanying drawings, but these examples should not be understood to limit the scope of the invention. In the examples, the invention is explained with an AC-driven surface charge type PDP for color display as an example.

Example 1

Figure 4:
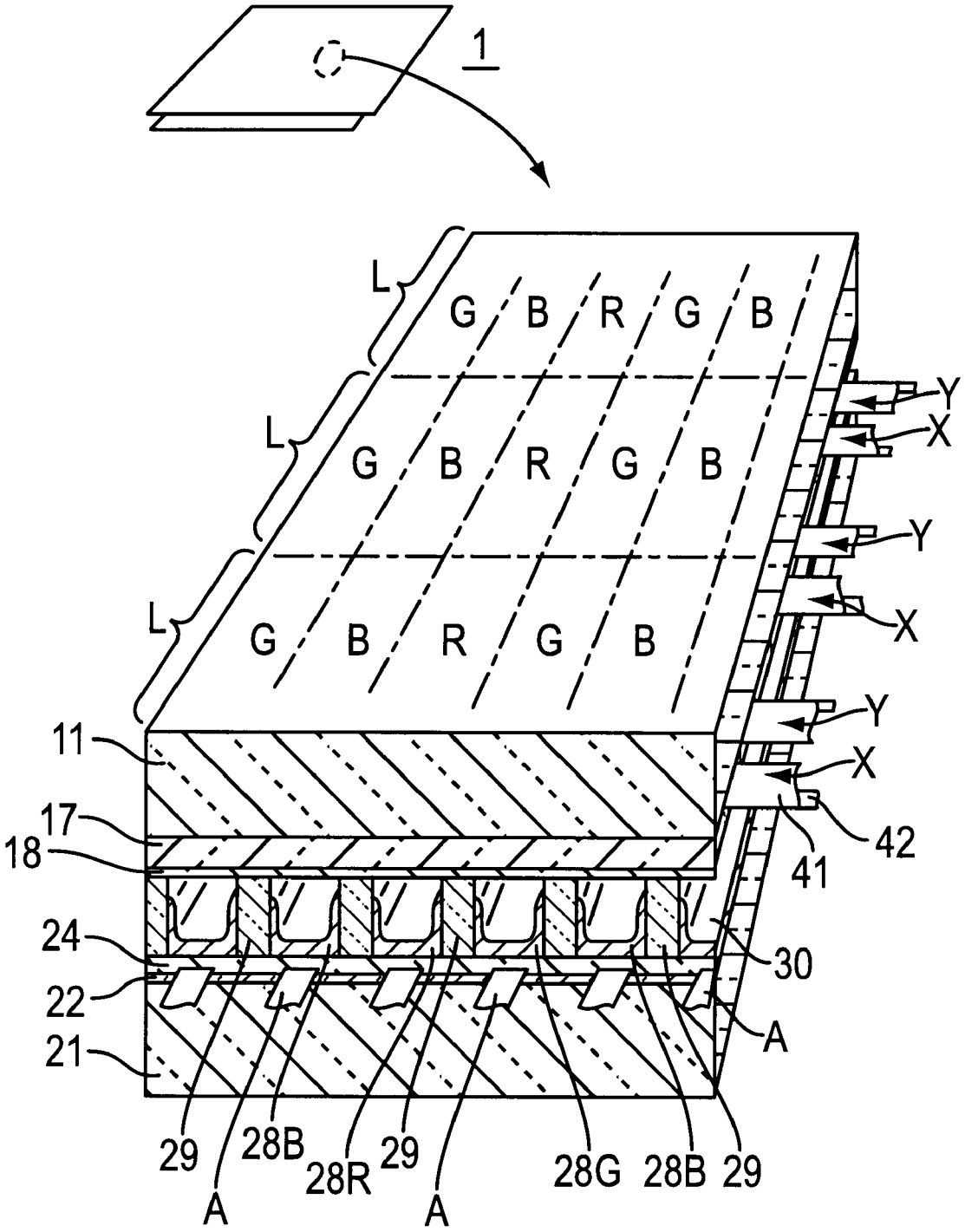
FIG. 4 is a perspective view illustrating the structure of an AC-driven surface discharge type PDP for color display.

FIG. 4 illustrates the structure of an AC-driven surface charge type PDP. A method of forming barrier ribs of a display panel of the invention is described with reference to this figure.

A pair of sustain electrodes X and Y are disposed for each line L for matrix display on an interior surface of a front glass substrate 11. Each of the sustain electrodes X and Y includes a transparent electrode 41 and a bus electrode 42 for preventing a decrease of voltage due to electric resistance of the transparent electrode 41. The sustain electrodes X and Y are covered with a dielectric layer 17. A protection film 18 of MgO is formed on a surface of the dielectric layer 17.

The front substrate 11 hereafter indicates a front substrate already provided with the sustain electrodes X and Y, the dielectric layer 17 and the protection film 18.

Formed on an interior surface of a rear glass substrate 21 are a base layer 22, address electrodes A in stripes, an insulating layer 24. On the insulating later 24, barrier ribs 29 for partitioning a discharge space are formed between the address electrodes. Fluorescent layers of red, green and blue, 28R, 28G and 28B, are formed by coating the address electrodes A and interior walls of the barrier ribs in grooves between the barrier ribs 29.

The rear substrate 21 hereafter indicates a rear substrate already provided with the base layer 22, the address electrodes A, and the insulating layer 24.

The front and rear substrates 11 and 21 thus produced are assembled together in an opposing relation into a color PDP1. Into the discharge space 30 between the front and rear substrates 11 and 21, a mixture gas of Ne and Xe is introduced.

A region where the sustain electrodes X and Y cross the address electrode A serves as a matrix display area when displaying, namely a subpixel. One pixel for display consists of three adjacent subpixels along the line L.

The barrier ribs 29 partition the discharge space 30 for each subpixel, and also ensure a predetermined spacing for the discharge space 30. The barrier ribs 29 prevent an electric discharge by an address electrode from affecting adjacent cells and prevents cross-talk of light.

The formation of the barrier ribs are now described in detail. FIGS. 5A to 5E illustrate a method of forming barrier ribs provided with the bind film. As shown in the figures, the barrier ribs of this example are formed by the following steps.

(1) Forming a barrier rib material layer (see FIG. 5A) The rear substrate 21 is first prepared. A barrier rib material layer 51 is formed in a predetermined thickness on the rear substrate 21. For plasma display, a glass paste of a glass powder, a filler and a binder is used as the barrier rib material. As the glass powder, a low-melting-point glass powder is used. However, any dielectric materials including ceramic powders can be used instead of the glass powder. As the filler, a powder of aluminum oxide is used, and as the binder, an organic material such as ethyl cellulose or an acrylic resin is used. The barrier rib material layer 51 is a plane film, and is formed by coating the rear substrate 21 with the glass paste by the screen printing method followed by drying. Particles of the glass powder attach here and there to the surface of the barrier rib material layer 51 thus formed, that is, the particles are in a free state.

Figure 5A:
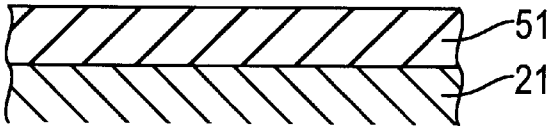
FIGS. 5A to 5E are sectional views illustrating a method of forming barrier ribs according to Embodiment 1.
Figure 5B:
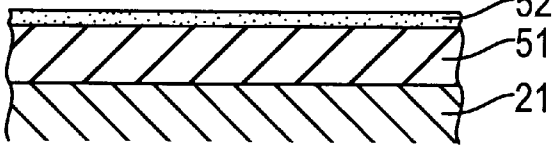

(2) Forming a bind film (see FIG. 5B)

A bind film 52 is formed on the barrier rib material layer 51. Used as the bind film 52 is a liquid of a solvent and the binder of the barrier rib material without the glass powder. Terpineol is used as the solvent.

The bind film 52 is formed by coating the barrier rib material layer 51 with the liquid of the binder and the solvent by the screen printing, or by a method using a spin coater, roll coater, slit coater, etc., followed by drying. A material different from the binder used for the barrier rib material may be used for the bind film 52 providing the material has similar properties.

By coating with the bind film 52, the free glass particles are fixed on the barrier rib material layer 51. For this reason, the adhesion of a later formed mask pattern improves, and the resistance to sandblasting improves. Accordingly, it is possible to form a finer pattern than the one conventionally formed.

Figure 5C:
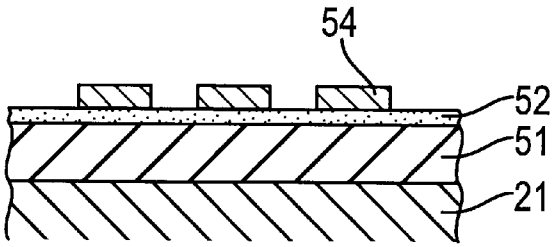

(3) Forming a pattern (see FIG. 5C)

A photoresist is spread on or a photosensitive dry film is put on the bind film 52. A mask pattern 54 of a barrier rib configuration is formed by photolithography. The mask pattern 54 is a striped pattern in a plane view.

Figure 5D:
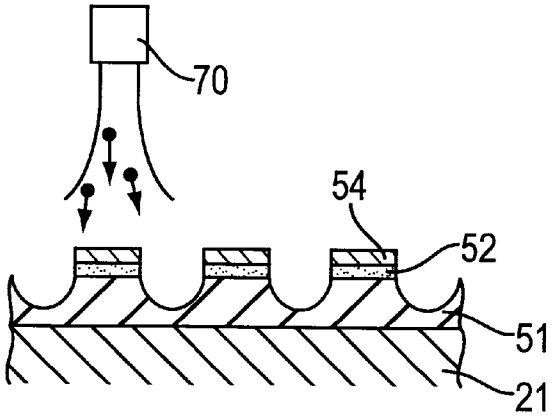

(4) Cutting (see FIG. 5D)

A cutting medium (an abrasive material) of several ten μm in size is jetted on a flow of air by a sandblaster 70 to remove a portion of the barrier rib material layer 51 and the bind film 52 that is not covered with the mask pattern 54 to form a cut barrier rib layer. Then, the mask pattern 54 is peeled off.

Figure 5E:
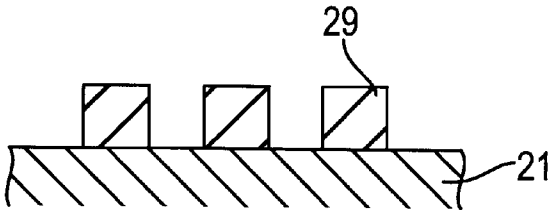

(5) Sintering (see FIG. 5E)

By sintering at high temperature of about 500° C. to about 600° C., the binder component in the cut barrier rib layer is burned off and, at the same time, the glass powder in the cut barrier rib layer is softened to fuse to each other. Barrier ribs 29 are thus formed.

The bind film 52 is also burned off because it is made of the binder material of the barrier rib material that does not contain any glass powder.

Example 2

The construction of PDP 1 is omitted from the following description of examples because the construction of PDP 1 is common to all the examples. Only the formation of the barrier ribs is described.

Figure 6A:
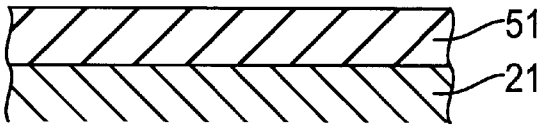
FIGS. 6A to 6E are sectional views illustrating a method of forming barrier ribs according to Embodiment 2.
Figure 6B:
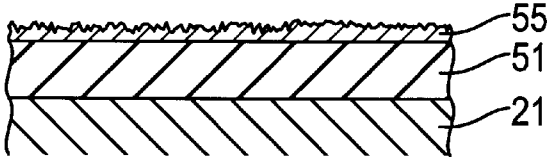
Figure 6C:
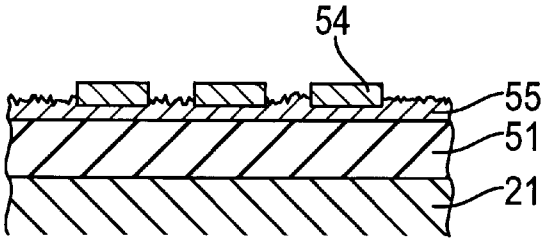
Figure 6D:
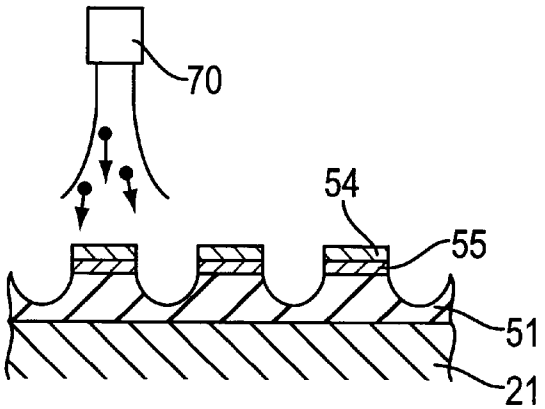
Figure 6E:
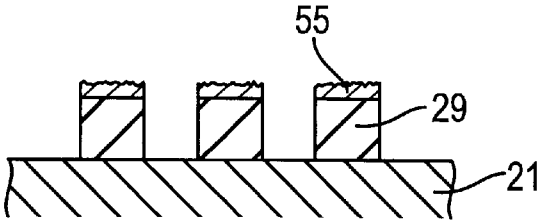

FIGS. 6A to 6E illustrate a method of forming barrier ribs provided with an adhesion-strengthen film. As shown in the figures, the barrier ribs of this example are formed by the following steps:

(1) Forming a barrier rib material layer (see FIG. 6A), (2) Forming an adhesion-strengthen film (see FIG. 6B), (3) Forming a pattern (see FIG. 6C), (4) Cutting (see FIG. 6D), (5) Sintering (see FIG. 6E).

Among these steps, the steps except the forming of an adhesion-strengthen film are the same as those in Example 1. Accordingly, only the step of forming the adhesion-strengthen film is described.

As described above, in the case where the barrier rib material layer 51 is formed by the blade coating method or the green-sheet method, the surface of the barrier rib material layer is relatively flat. Consequently, even if the method of forming the barrier ribs in Example 1 is applied, the adhesion between the mask pattern and the barrier rib material layer cannot be much improved, as shown in FIG. 3B.

An adhesion-strengthen film 55 having a considerably undulating surface is formed on the barrier rib material layer 51, and then the mask pattern 54 is formed thereon. Thus, the adhesion between the barrier rib material layer 51 and the mask pattern 54 is strengthened even if the barrier rib material layer has a flat surface.

For the adhesion-strengthen film 55, the same material as the barrier rib material is used. However, a material containing a glass component larger in particle diameter than the glass component of the barrier rib material may also be used. The adhesion-strengthen film 55 is formed by the screen printing method using a large-mesh screen.

The surface undulation of the adhesion-strengthen film 55 is flattened by abrading after sintering the cut barrier rib layer.

In this example, the adhesion-strengthen film 55 is formed on the barrier rib material layer 51. However, the surface of the barrier rib material layer 51 may be roughened instead of forming the adhesion-strengthen film 55.

In the screen printing method, the barrier rib material layer 51 is generally formed by repeating the printing several times. The surface of the barrier rib material layer 51 may be roughened by printing the same material as the barrier rib material to form the adhesion-strengthen layer 55 at the last printing.

Example 3

Figure 7A:
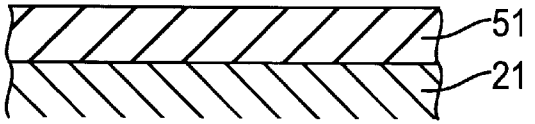
FIGS. 7A to 7F are sectional views illustrating a method of forming barrier ribs according to Embodiment 3.
Figure 7B:
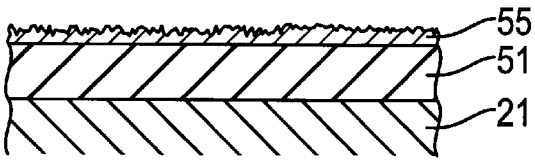
Figure 7C:
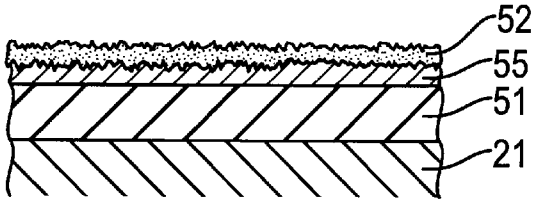
Figure 7D:
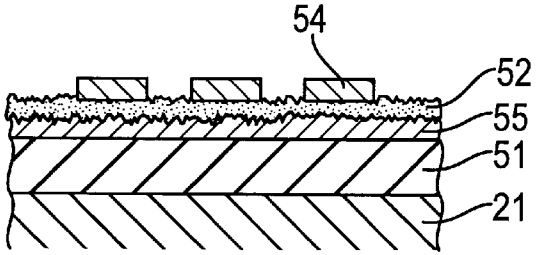
Figure 7E:
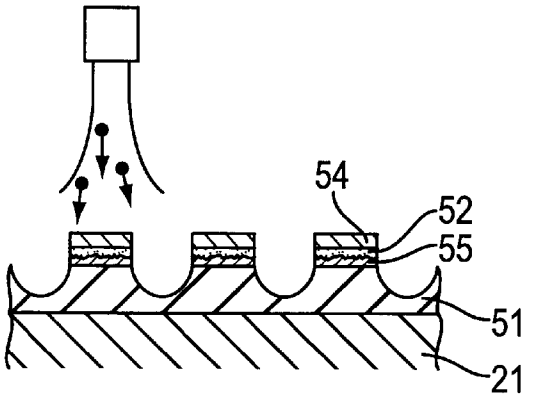
Figure 7F:
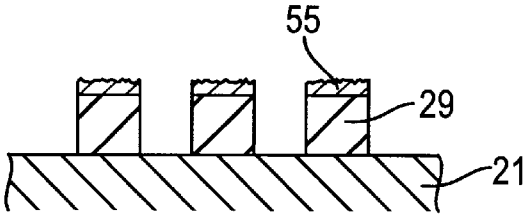

FIGS. 7A to 7F illustrate a method of forming barrier ribs provided with an adhesion-strengthen film and a bind film. As shown in the figures, the barrier ribs of this example are formed by the following steps:

(1) Forming a barrier rib material layer (see FIG. 7A), (2) Forming an adhesion-strengthen film (see FIG. 7B), (3) Forming a bind film (see FIG. 7C), (4) Forming a pattern (see FIG. 7D), (5) Cutting (see FIG. 7E), (6) Sintering (see FIG. 7F).

Among these steps, the steps except the forming of an adhesion-strengthen film are the same as those in Example 1, and the step of forming an adhesion-strengthen film is the same as that in Example 2.

In this example, a considerably undulating adhesion-strengthen film 55 is formed on a barrier rib material layer 51 having a flat surface, and further a bind film 52 is formed thereon. Consequently, the surface of the barrier rib material layer 51 is considerably undulating and also does not have glass particles attaching thereto. Thus, the adhesion between the barrier rib material layer 51 and the mask pattern 54 can be further improved over Example 2.

Example 4

Figure 8D:
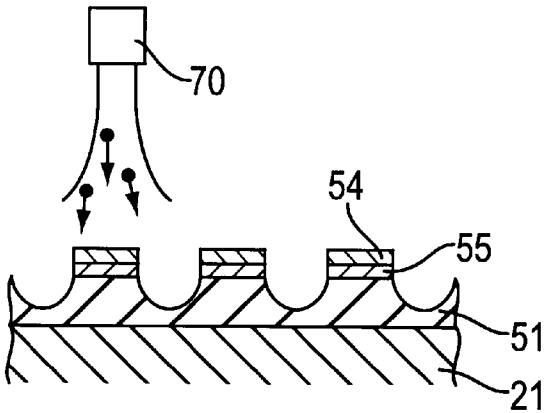
FIGS. 8A to 8F are sectional views illustrating a method of forming barrier ribs according to Embodiment 4.
Figure 8E:
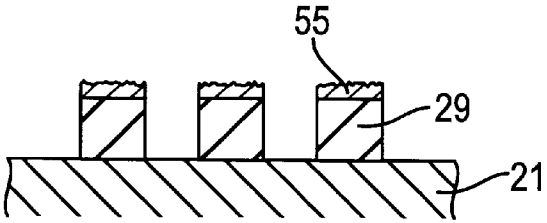
Figure 8F:
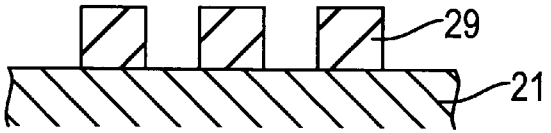
Figure 8A:
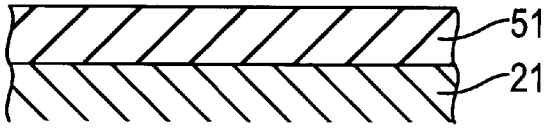
Figure 8B:
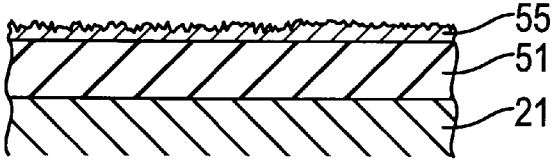
Figure 8C:
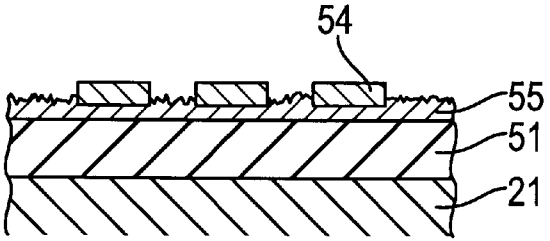

FIGS. 8A to 8F illustrate a method of forming the barrier ribs provided with an adhesion-strengthen film which is removed after sintering. As shown in the figures, the barrier ribs of this example are formed by the following steps:

(1) Forming a barrier rib material layer (see FIG. 8A), (2) Forming an adhesion-strengthen film (see FIG. 8B), (3) Forming a pattern (see FIG. 8C), (4) Cutting (see FIG. 8D), (5) Sintering (see FIG. 8E), (6) Removing the adhesion-strengthen film (see FIG. 8F).

Among these steps, the steps except the removing of the adhesion-strengthen film are the same as those in Example 2.

In this example, the adhesion-strengthen film 55 is formed of a material which does not change at the maximum working temperature such as the sintering temperature. An example of such a material is a $SiO_2$ glass paste which has a softening point higher than the working temperature. Where the adhesion-strengthen film is formed of the $SiO_2$ glass paste, part of the adhesion-strengthen film, unlike the low-melting-point glass paste of Example 2, does not fuse to the underlying barrier rib material layer during the sintering. Therefore, the flatness of the surface of the barrier rib material layer is not impaired. Further, in the removal step, the adhesion-strengthen film 55 can easily be removed by the ultrasonic cleaning or air blowing. By this removal, the flat surface of the barrier ribs is exposed.

According to this example, the top surface of the barrier ribs can be flattened without abrading the surface undulation of the adhesion-strength layer after sintering.

In this example, only the adhesion-strengthen film 55 is formed on the barrier rib material layer 51. However, the bind film 52 may further be formed on the adhesion-strengthen film 55 to further improve the adhesion between the barrier rib material layer 51 and the mask pattern 54.

Example 5

Figure 9E:
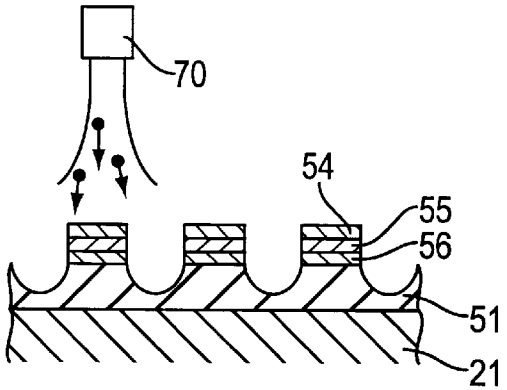
FIGS. 9A to 9G are sectional views illustrating a method of forming barrier ribs according to Embodiment 5.
Figure 9F:
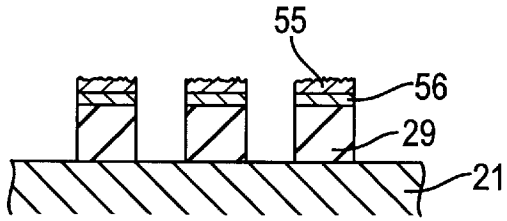
Figure 9G:
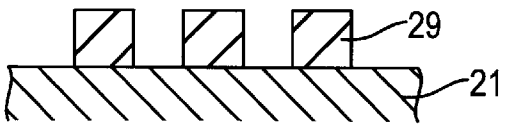
Figure 9A:
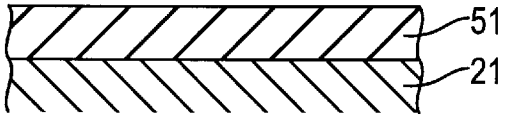
Figure 9B:
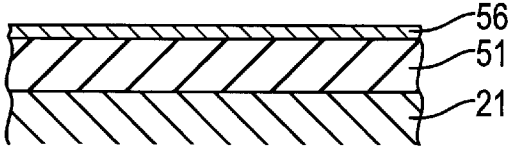
Figure 9C:
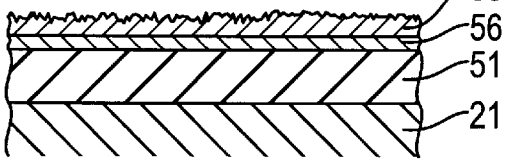
Figure 9D:
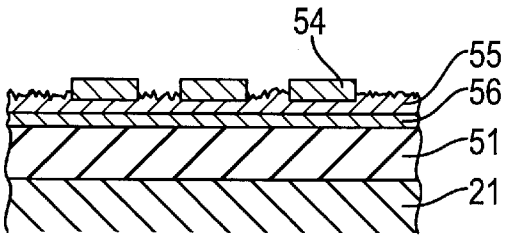

FIGS. 9A to 9G illustrate a method of forming barrier ribs provided with a lift-off layer and an adhesion-strengthen film which are removed after sintering. As shown in the figures, the barrier ribs of this example are formed by the following steps:

(1) Forming a barrier rib material layer (see FIG. 9A), (2) Forming a lift-off layer (see FIG. 9B), (3) Forming an adhesion-strengthen film (see FIG. 9C), (4) Forming a pattern (see FIG. 9D), (5) Cutting (see FIG. 9E), (6) Sintering (see FIG. 9F), (7) Lifting off the lift-off layer (see FIG. 9G).

Among these steps, the steps except the forming of a lift-off layer and the lifting-off of the lift-off layer are the same as those in Example 2.

This example is to solve the problem that, in Example 2, part of the adhesion-strengthen film 55 fuses to the barrier rib material layer 51 during the sintering and consequently the flatness of the surface is impaired.

The lift-off layer 56 which can be removed together with the adhesion-strengthen film 55 after the sintering is formed on the barrier rib material layer 51. The lift-off layer 56 is formed of fine particles of aluminum oxide which does not change its form at the maximum working temperature such as the sintering temperature and has a minute particle diameter. Instead of aluminum oxide, titanium oxide may also be used. The lift-off layer 56 is formed by the printing method. The lift-off layer 56 is removed by the ultrasonic cleaning or air blowing.

According to this example, the adhesion-strengthen film 55 improves the adhesion between the barrier rib material layer and the mask pattern during the cutting step. Also the lift-off layer 56 prevents the impairment of the surface flatness of the barrier rib material layer during the sintering. Thus, the flatness of the surface of the barrier ribs can be maintained.

In this example, the lift-off layer 56 and the adhesion-strengthen film 55 are formed on the barrier rib material layer 51. However, the bind film 52 may further be formed on the adhesion-strengthen film 55 to further improve the adhesion between the barrier rib material layer 51 and the mask pattern 54.

Example 6

Figure 10E:
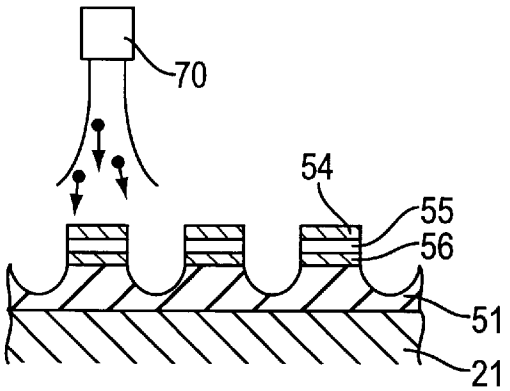
FIGS. 10A to 10G are sectional views illustrating a method of forming barrier ribs according to Embodiment 6.
Figure 10F:
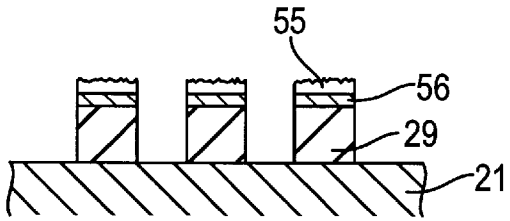
Figure 10G:
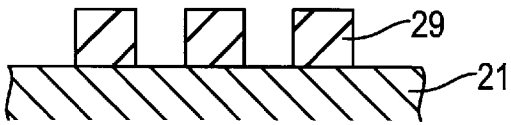
Figure 10A:
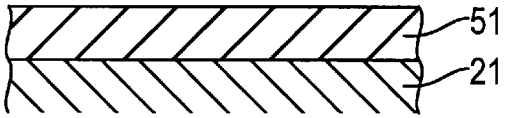
Figure 10B:
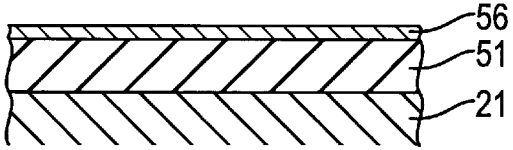
Figure 10C:
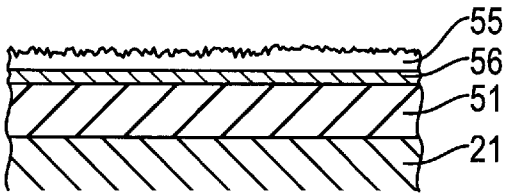
Figure 10D:
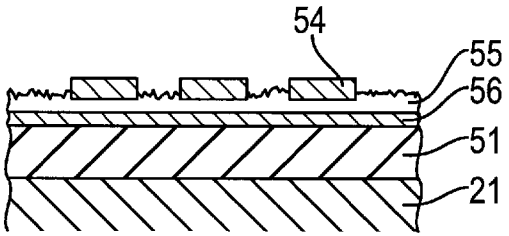

FIGS. 10A to 10G illustrate a method of forming white barrier ribs and a black adhesion-strengthen film. As shown in the figures, the barrier ribs are formed by the following steps:

(1) Forming a white barrier rib material layer (see FIG. 10A), (2) Forming a lift-off layer (see FIG. 10B), (3) Forming a black adhesion-strengthen film (see FIG. 10C), (4) Forming a pattern (see FIG. 10D), (5) Cutting (see FIG. 10E), (6) Sintering (see FIG. 10F), (7) Lifting off the lift-off layer (see FIG. 10G).

Among these steps, the steps except the forming of a white barrier rib material layer and a black adhesion-strengthen film are the same as those in Example 5.

In this example, a white glass paste of high viscosity is used for the barrier rib. The use of the white barrier rib material layer is to improve reflection in a luminous state after the panel is fabricated into a plasma display. The barrier rib material layer 51 is whitened by mixing alumina ($Al_2O_3$) or titania ($TiO_2$) with the glass paste. The black adhesion-strengthen film 55 is employed in order to inhibit irregular reflection when exposed to light in the photolithography. The adhesion-strengthen film 55 is blackened by mixing CuO or CrO with the low-melting-point glass paste. The barrier rib material layer 51 and the adhesion-strengthen film are formed by the same printing method as in Example 5.

According to this example, since the adhesion-strengthen film 55 is black, the irregular reflection is inhibited at the light exposure in the photolithography for forming the mask pattern. Thus, the patterning of the mask pattern is improved. Also, the luminous efficiency of the fabricated panel display is improved due to the white barrier ribs.

In this example, the lift-off layer 56 and the adhesion-strengthen film 55 are formed on the barrier rib material layer 51 as in Example 5. However, the bind film 52 may further be formed on the adhesion-strengthen film 55 to further improve the adhesion between the barrier rib material 51 and the mask pattern 54.

Example 7

Figure 11F:
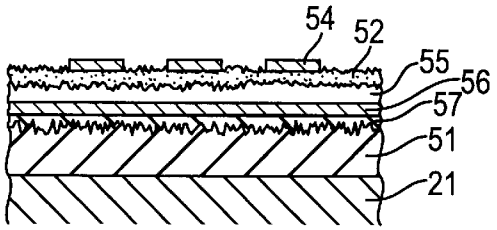
FIGS. 11A to 11I are sectional views illustrating a method of forming barrier ribs according to Embodiment 7.
Figure 11G:
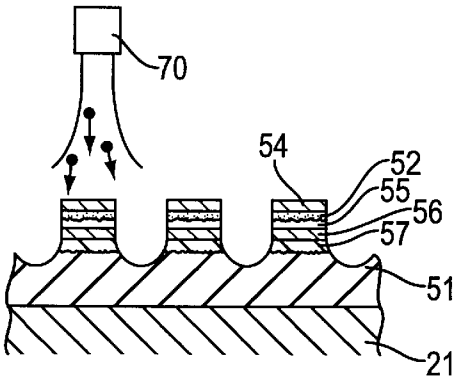
Figure 11H:
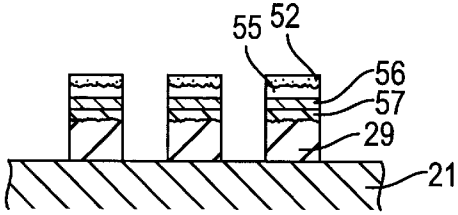
Figure 11I:
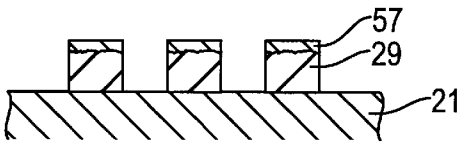
Figure 11A:
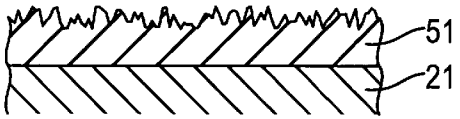
Figure 11B:
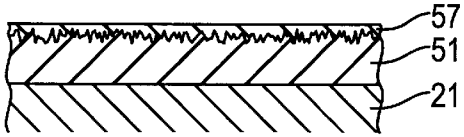
Figure 11C:
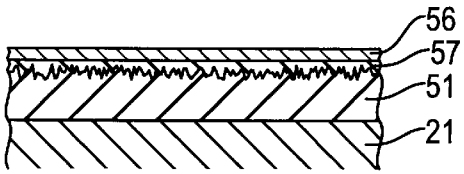
Figure 11D:
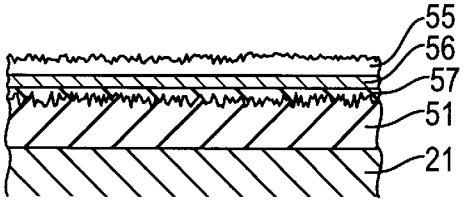
Figure 11E:
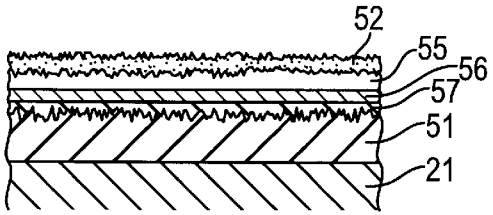

FIGS. 11A to 11I illustrate a method of forming white barrier ribs provided with a flat layer, a lift-off layer and a black adhesion-strengthen film, and removing the lift-off layer together with the layers formed thereon after sintering. As shown in the figures, the barrier ribs of this example are formed by the following steps:

(1) Forming a white barrier rib material layer (see FIG. 11A), (2) Forming a flat layer (see FIG. 11B), (3) Forming a lift-off layer (see FIG. 11C), (4) Forming a black adhesion-strengthen film (see FIG. 11D), (5) Forming a bind film (see FIG. 11E), (6) Forming a pattern (see FIG. 11F), (7) Cutting (see FIG. 11G), (8) Sintering (see FIG. 11H), (9) Lifting off the lift-off layer (see FIG. 11I).

Among these steps, the steps except the forming of a flat layer and a bind film are the same as those in Example 6, and the step of forming a bind film is the same as that in Example 3.

In the step of forming a white barrier rib material layer, a white glass paste of high viscosity is used for the barrier rib material as in Example 6. The barrier rib material layer 51 is formed by the screen printing using a large-mesh screen so that the barrier rib material layer of a desired height can be formed by a small number of printings. In this case, since the large-mesh screen is used, the surface of the barrier rib material layer 51 has a lot of undulations.

The flat layer 57 having a flat surface is formed by coating the barrier rib material layer 51 with a fine powder paste using glass powder smaller in particle diameter than the barrier rib material, followed by drying.

Figure 12A:
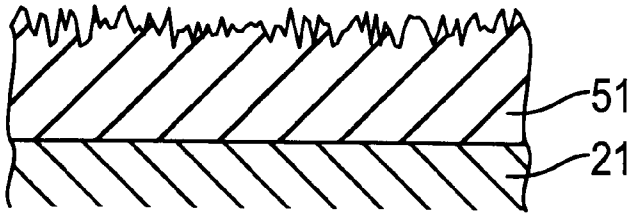
FIGS. 12A to 12C are sectional views illustrating a flat layer of a paste of fine particles.
Figure 12B:
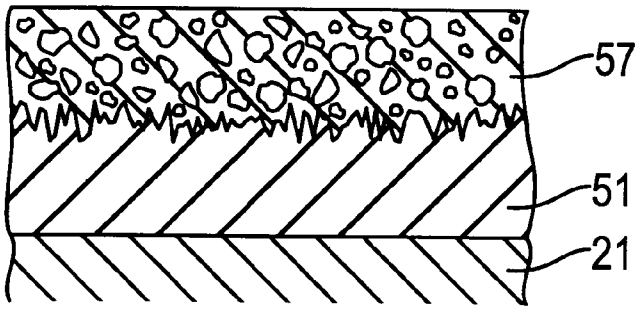
Figure 12C:
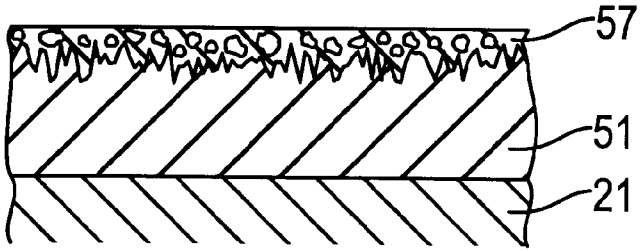

That is, the rough-surface barrier rib material layer 51 (see FIG. 12A) is coated with a fine powder paste using a glass powder having a smaller average particle diameter than the barrier rib material (see FIG. 12B), and dried (see FIG. 12C). Thereby the flat layer 57 is formed. The small glass powder remains in the fine powder paste just after coating but embeds in concaves of the undulations of the barrier rib material layer 51 after drying.

Alternatively, the flat layer 57 may be formed by coating the barrier rib material layer 51 with a glass paste having lower viscosity than the barrier rib material.

Figure 13A:
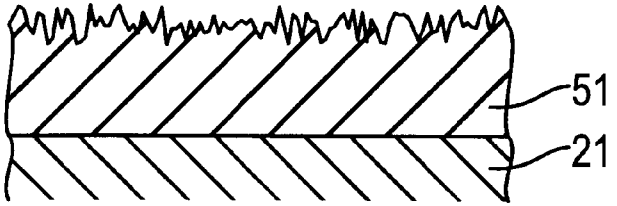
FIGS. 13A to 13C are sectional views illustrating a flat layer of a glass paste of low viscosity.
Figure 13B:
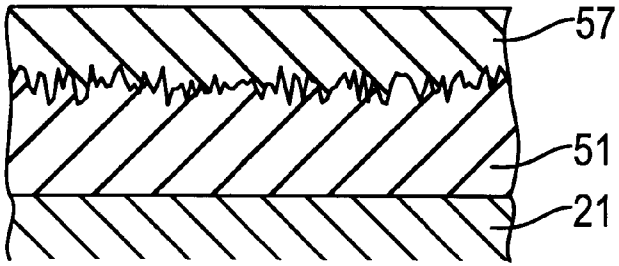
Figure 13C:
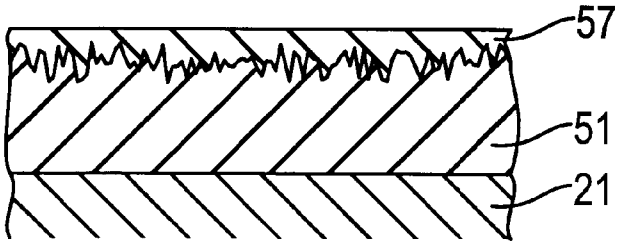
Figure 14A:
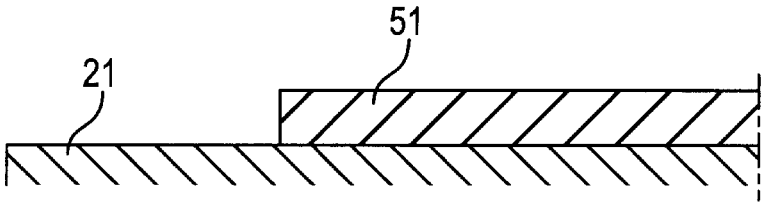
FIG. 14A PRIOR ART
FIGS. 14A to 14D are sectional views illustrating a conventional method of forming barrier ribs.
Figure 14B:
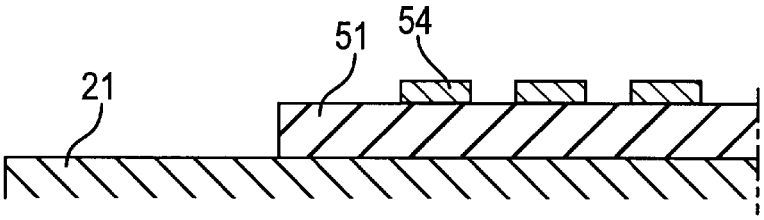
FIG. 14B PRIOR ART
Figure 14C:
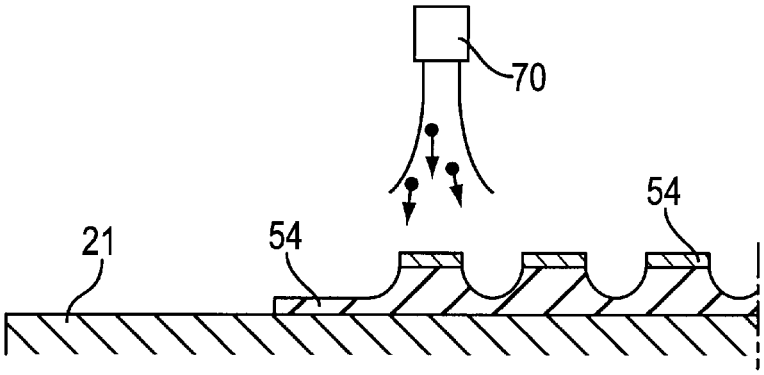
FIG. 14C PRIOR ART
Figure 14D:
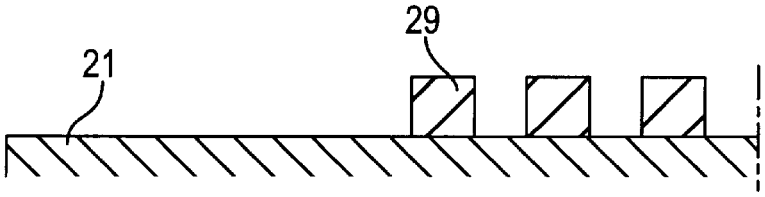
FIG. 14D PRIOR ART

That is, the rough-surface barrier rib material layer 51 (see FIG. 13A) is coated with a glass paste having lower viscosity than the barrier rib material (see FIG. 13B), and dried (see FIG. 13C). Thereby, the flat layer 57 is formed. In this case, the low-viscosity glass paste is easily made into a flat layer at the coating. Furthermore, since the low-viscosity glass paste dries with maintaining its flatness, it embeds in the concaves of the undulations of the barrier rib material layer 51 after drying.

The coating with the flat layer 57 may be conducted by the screen printing, by coating using a metal mask without a mesh, or by using a spin coater, a roll coater, a slit coater or the like. For obtaining a flat surface, it is preferred to employ a method which does not use a mesh screen.

According to the method of forming barrier ribs of this example, the adhesiveness of the mask pattern is improved without impairing the flatness of the surface of the barrier ribs. The pattern can be made in a finer configuration than conventionally made. In addition, the luminous efficiency when emitting light is improved due to the white barrier ribs and the patterning when exposed to light is also improved due to the black adhesion-strength layer.

To sum up, according to the present invention, the adhesion of the mask pattern to the barrier rib material layer is improved by fixing the free powdery component on the surface of the barrier rib material layer. The improved adhesion of the mask pattern brings to an improved resistance to cutting work and thereby allows a finer pattern to be formed than in conventional methods. Besides, the barrier ribs can be formed to have a flatter top surface than in prior art without damaging the adhesion of the mask pattern.

What is claimed is:

1. A method of forming barrier ribs of a display panel comprising:

forming a layer of a dielectric paste comprising a powdery component and a binder component as a layer of a barrier rib material in a predetermined thickness on a substrate;

forming a mask pattern on the dielectric paste layer before firing;

jetting a cutting medium onto the dielectric paste layer through the mask pattern to partially cut the dielectric paste layer to thereby form a cut barrier rib layer; and firing the cut barrier rib layer to make barrier ribs, wherein, prior to forming the mask pattern, the unfired dielectric paste layer is coated with a bind film which does not contain a powdery component for fixing the powdery component of the dielectric paste in a free state on a surface of the unfired dielectric paste layer and then the bind film is dried.

2. The method according to claim 1, wherein the bind film comprises a same kind of binder as the binder component of the dielectric paste.

3. The method according to claim 1, wherein the surface of the dielectric paste layer is roughened.

4. The method according to claim 1, wherein a surface of the barrier ribs is abraded after firing the cut barrier rib layer.

5. A method of forming barrier ribs of a display panel comprising:

forming a layer of a barrier rib material on a substrate;

forming a mask pattern on the barrier rib material layer before firing;

jetting a cutting medium onto the barrier rib material layer through the mask pattern to partially cut the barrier rib material layer to thereby form a cut barrier rib layer; and firing the cut barrier rib layer to make barrier ribs, wherein, prior to forming the mask pattern, an undulating surface film is formed on the barrier rib material layer for strengthening adhesion between the mask pattern and the barrier rib material layer, the undulating surface film having a rougher surface than that of the barrier rib material layer.

6. The method according to claim 5, wherein the undulating surface film is formed of a dielectric paste comprising a powdery component and a binder component and then a bind film is formed for fixing the powdery component in a free state on a surface of the dielectric paste film.

7. The method according to claim 6, wherein the barrier rib material layer is formed of a dielectric paste comprising a powdery component and a binder component and the bind film comprises the same kind of binder as the binder component of the dielectric paste used as the barrier rib material or the same kind of binder as the binder component of the dielectric paste used as a material for the undulating surface film.

8. The method according to claim 5, wherein, after firing the cut barrier rib layer, the surface of the adhesion-strengthen film is abraded or the undulating surface film is removed.

9. The method according to claim 5, wherein a lift-off layer is formed on the barrier rib material layer prior to forming the undulating surface layer, the lift-off layer being composed of a powdery material which does not change its form at a temperature for firing the cut barrier rib layer, and the lift-off layer is removed together with the undulating surface layer after firing the cut barrier rib layer.

10. The method according to claim 9, wherein the barrier rib material layer is formed of a dielectric paste comprising a powdery component and a binder component and a flat layer is formed on the barrier rib material layer prior to forming the lift-off layer, the flat layer being composed of a dielectric paste containing a powdery component smaller in particle diameter than the powdery component contained in the dielectric paste used as the barrier rib material, whereby flatness of the surface of the barrier rib material layer is improved.

11. The method according to claim 9, wherein the barrier rib material layer is formed of a dielectric paste having a predetermined viscosity and a flat layer is formed on the barrier rib material layer prior to forming the lift-off layer, the flat layer being composed of a dielectric paste having a lower viscosity than the viscosity of the dielectric paste used as the barrier rib material, whereby flatness of the surface of the barrier rib material layer is improved.

12. A method of forming barrier ribs of a display panel comprising:

forming a layer of a dielectric paste comprising a powdery component and a binder component as a layer of a barrier rib material in a predetermined thickness on a substrate;

forming a mask pattern on the dielectric paste layer;

jetting a cutting medium onto the dielectric paste layer through the mask pattern to partially cut the dielectric paste layer to thereby form a cut barrier rib layer; and sintering the cut barrier rib layer to make barrier ribs, wherein, prior to forming the mask pattern, a bind film is formed for fixing the powdery component of the dielectric paste in a free state on a surface of the unfired dielectric paste layer, wherein the bind film comprises a same kind of binder as the binder component of the dielectric paste.

13. A method of forming barrier ribs of a display panel comprising:

forming a layer of a dielectric paste comprising a powdery component and a binder component as a layer of a barrier rib material in a predetermined thickness on a substrate;

forming a mask pattern on the dielectric paste layer;

jetting a cutting medium onto the dielectric paste layer through the mask pattern to partially cut the dielectric paste layer to thereby form a cut barrier rib layer; and sintering the cut barrier rib layer to make barrier ribs, wherein, prior to forming the mask pattern, a bind film is formed for fixing the powdery component of the dielectric paste in a free state on a surface of the unfired dielectric paste layer, wherein a surface of the barrier ribs is abraded after sintering the cut barrier rib layer.

14. A method of forming barrier ribs of a display panel comprising:

forming a layer of a barrier rib material on a substrate;

forming a mask pattern on the barrier rib material layer;

jetting a cutting medium onto the barrier rib material layer through the mask pattern to partially cut the barrier rib material layer to thereby form a cut barrier rib layer; and sintering the cut barrier rib layer to make barrier ribs, wherein, prior to forming the mask pattern, an adhesion-strengthen film is formed on the barrier rib material layer for strengthening adhesion between the mask pattern and the barrier rib material layer, the adhesion-strengthened film having a rougher surface than that of the barrier rib material layer, wherein the adhesion-strengthen film is formed of a dielectric paste comprising a powdery component and a binder component and then a bind film is formed for fixing the powdery component in a free state on a surface of the dielectric paste film, wherein the barrier rib material layer is formed of a dielectric paste comprising a powdery component and a binder component and the bind film comprises the same kind of binder as the binder component of the dielectric paste used as the barrier rib material or the same kind of binder as the binder component of the dielectric paste used as a material for the adhesion-strengthen film.

15. A method of forming barrier ribs of a display panel comprising:

forming a layer of a barrier rib material on a substrate;

forming a mask pattern on the barrier rib material layer;

jetting a cutting medium onto the barrier rib material layer through the mask pattern to partially cut the barrier rib material layer to thereby form a cut barrier rib layer; and sintering the cut barrier rib layer to make barrier ribs, wherein, prior to forming the mask pattern, an adhesion-strengthen film is formed on the barrier rib material layer for strengthening adhesion between the mask pattern and the barrier rib material layer, the adhesion-strengthened film having a rougher surface than that of the barrier rib material layer, wherein a lift-off layer is formed on the barrier rib material layer prior to forming the adhesion-strengthen layer, the lift-off layer being composed of a powdery material which does not change its form at a temperature for sintering the cut barrier rib layer, and the lift-off layer is removed together with the adhesion-strengthen layer after sintering the cut barrier rib layer.

16. The method according to claim 15, wherein the barrier rib material layer is formed of a dielectric paste comprising a powdery component and a binder component and a flat layer is formed on the barrier rib material layer prior to forming the lift-off layer, the flat layer being composed of a dielectric paste containing a powdery component smaller in particle diameter than the powdery component contained in the dielectric paste used as the barrier rib material, whereby flatness of the surface of the barrier rib material layer is improved.

17. The method according to claim 15, wherein the barrier rib material layer is formed of a dielectric paste having a predetermined viscosity and a flat layer is formed on the barrier rib material layer prior to forming the lift-off layer, the flat layer being composed of a dielectric paste having a lower viscosity than the viscosity of the dielectric paste used as the barrier rib material, whereby flatness of the surface of the barrier rib material layer is improved.

18. A method of forming barrier ribs for a display panel, comprising:

forming a layer of dielectric paste as a layer of a barrier rib, wherein the dielectric paste includes a powdery component and a binder component;

forming a bind film on a surface of the dielectric paste layer to fix the powdery component, wherein the bind film consists of a same kind of binder as the binder component; and using a mask pattern to form ribs on the dielectric layer.

19. A method of forming barrier ribs for a display panel, comprising:

forming a layer of dielectric paste as a layer of a barrier rib, wherein the dielectric paste includes a powdery component and a binder component;

forming a bind film on a surface of the dielectric paste layer to fix the powdery component;

forming a cut barrier rib layer using a mask pattern; and firing the cut barrier rib layer to make barrier ribs on the dielectric layer, wherein a surface of the barrier ribs is abraded.

20. A method of forming barrier ribs for a display panel, comprising:

forming a lift-off layer on a barrier rib material layer on a substrate, the lift-off layer composed of a powdery material;

forming an undulating surface film on top of the lift-off layer to strengthen adhesion between the barrier rib material layer and a mask pattern;

using the mask pattern to form ribs on the barrier rib material layer; and removing the lift-off layer together with the undulating surface layer.

21. The method according to claim 20, wherein the undulating surface film has a rougher surface than that of the barrier rib material layer.

22. The method according to claim 20, wherein the lift-off layer is composed of one of aluminum oxide, titanium oxide or any powdery material which does not change at a firing temperature.

* * * * *

UNITED STATES PATENT AND TRADEMARK OFFICE

CERTIFICATE OF CORRECTION

PATENT NO.: 6,039,622
DATED : March 21, 2000
INVENTOR(S): Tadayoshi KOSAKA, et al.

It is certified that an error appears in the above-identified patent and that said Letters Patent is hereby corrected as shown below:

[54] Title

Change "OF" (second occurrence) to --FOR A--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*